United States Patent [19]

Matsushima et al.

[11] 4,220,486

[45] Sep. 2, 1980

[54] CONVERSION COATING SOLUTION FOR TREATING METALLIC SURFACES

[75] Inventors: Yasunobu Matsushima, Kawasaki; Nobuyuki Oda, Yokohama; Haruyoshi Terada, Tanashi, all of Japan

[73] Assignee: Nihon Parkerizing Co., Ltd., Japan

[21] Appl. No.: 55,286

[22] Filed: Jul. 6, 1979

[30] Foreign Application Priority Data

Oct. 30, 1978 [JP] Japan ..... 53-133556

[51] Int. Cl.[2] ..... C23F 7/08

[52] U.S. Cl. ..... 148/6.15 R; 148/6.17

[58] Field of Search ..... 148/6.15 R, 6.17, 6.27

[56] References Cited

U.S. PATENT DOCUMENTS

| | | | |
|---|---|---|---|
| 2,357,269 | 8/1944 | Russell et al. | 148/6.15 R |
| 2,490,062 | 12/1949 | Jernstedt | 148/6.15 R |
| 2,702,768 | 2/1955 | Hyams | 148/6.15 R |
| 3,515,600 | 6/1970 | Jones et al. | 148/6.15 R |
| 3,839,099 | 10/1974 | Jones | 148/6.15 R |

*Primary Examiner*—Ralph S. Kendall

*Attorney, Agent, or Firm*—Ostrolenk, Faber, Gerb & Soffen

[57] ABSTRACT

A conversion coating solution for treating metallic surfaces is able to form conversion coating films having excellent anticorrosiveness and giving good adhesiveness and gloss to the overcoating. The conversion coating solution has a pH value of 5.5 to 6.5 and contains 0.1 to 50 g/liter as phosphate ion of acid salts of alkali phosphates, 0.01 to 0.5 g/liter of stannous ion and 2 to 12-fold by weight as much fluorine ion as the stannous ion. The conversion coating solution may be further combined with 0.2 to 5 g/liter of at least one of pyrazole compounds, hydroxylamine compounds and hydrazine compounds.

6 Claims, No Drawings

CONVERSION COATING SOLUTION FOR TREATING METALLIC SURFACES

BACKGROUND OF THE INVENTION

1. Field of the Invention

This invention relates to a conversion coating solution for treating metallic surfaces. More particularly, the invention relates to a phosphate conversion coating solution for treating the metallic surfaces of steels, tin-plated steel sheets and the like, and especially for treating the naked surfaces of base matals that are exposed by drawing and other working, for example, the exposed surfaces of tin-plated cans.

2. Description of the Prior Art

The phosphate conversion coating solutions for treating metallic surfaces are roughly divided into two kinds; one is a conversion coating solution which contains metal phosphates as the main components and the other is a conversion coating solution which contains alkali phosphates as the main components. The former conersion coating solution containing metal phosphates is composed of main components of acid metal phosphates including metallic ions such as Zn ion and Mn ion, oxidizing agents such as $NaClO_3$, $NaNO_3$, $NaNO_2$ and organic oxidizing agents, and halogen compounds such as fluorides which break up the passivated layers on metallic surfaces so as to cause the corrosive reaction to proceed evenly and to promote the conversion reaction. By the conversion reaction, the coating film consisting of the insoluble salts of the metal phosphate is formed on the surface of the treated metal, thereby contributing to the improvement in the durability of the additional coating, as the anticorrosive ground coating film.

Nevertheless, the pH value of this conversion coating solution is 1.8 to 3.5 and it contains free acid, accordingly, in the initial stage of the conversion treatment for a metal substrate, the metallic surface is severely corroded and much metal is dissolved out. Therefore, in the case that thinly tin-plated steel sheets are treated, the tin plate layers become thinner because the tin in the surface portion of the tin plate layers is dissolved. Therefore, the expected effect to improve anticorrosive function to the metal substrate by the tin plate is completely lost. Furthermore, since the coating film formed by the conversion coating treatment is relatively thick and, in addition, the crystal particles are coarse, it is disadvantageous that even smooth coating films cannot be formed by the print coating of several microns in thickness and the adhesiveness of coating films is not satisfactory.

The latter alkali phosphate conversion coating solution contains main components of acid alkali phosphates such as sodium phosphate, potassium phosphate and ammonium phosphate, and film formation promoters of oxidizing agents such as $NaClO_3$, $NaBrO_3$, $NaNO_2$ and hydroxyl amine salt and halogen compounds such as fluorides. This conversion coating solution has a higher pH value (of 4.0 to 5.5) compared to that of the former metal phosphate conversion coating solution and does not contain free acid so that the dissolution of the metal to be treated during the conversion coating process is little and the coating film is thin. Therefore, the adhesiveness of overcoating film to the substrate surface is good and the gloss of overcoating is good. However, the anticorrosive property is not good.

In any treating process, the treated surface after the conversion coating step is subjected to the succeeding steps of water rinsing, drying and overcoating. However, in these steps, the treated surface is exposed to the atmosphere in a workshop. Since the conventional conversion coating film is mainly composed of phosphates, the anticorrosiveness is not sufficient and the treated surfaces gather rust during the above steps due to the low anticorrosiveness. Therefore, the conversion coating becomes absurd substantially after it is overcoated.

BRIEF SUMMARY OF THE INVENTION

It is, therefore, the primary object of the present invention to provide an improved conversion coating solution for treating metallic surfaces with which the above-described disadvantages in the conventional art can be eliminated.

Another object of the present invention is to provide a conversion coating solution with which conversion coating film can be formed that is excellent in anticorrosiveness and closeness.

A further object of the present invention is to provide a conversion coating solution which provides the next overcoating with excellent adhesiveness, anticorrosiveness and surface gloss.

A still further object of the present invention is to provide a conversion coating solution which is stable in use and continuously forms uniform conversion coating films without fail.

Pursuant to the above objects of the invention, the conversion coating solution of the present invention has a pH value in the range of 5.5 and 6.5 and contains therein 0.1 g/liter to 50 g/liter as phosphate ion of acid salts of alkali phosphates, 0.01 g/liter to 0.5 g/liter of stannous ion, and 2 to 12-fold by weight as much fluorine ion as the stannous ion. Further, 0.2 to 5 g/liter of one or more members of pyrazole, hydroxylamine and hydrazine compounds are added to the above treating solution. With the existence of stannous ion and fluorine ion in the form of complex ions, both substances are able to exist stably and the treating solution becomes also stable. By treating metallic surfaces with using the above conversion coating solution, the coating film containing insoluble tin phosphate can be continuously formed in a uniform state. The bonding between a substrate and the conversion coating film itself is quite strong with the result of improvement in anticorrosiveness and the adhesiveness, and the anti-corrosiveness and gloss of the subsequently applied overcoating become good.

These and other objects and features of the present invention will become more apparent to those skilled in the art from the following detailed description.

DETAILED DESCRIPTION OF THE INVENTION

The acid salts (hydrogen salts) of alkali phospates, used in the present invention are exemplified by the sodium, potassium and ammonium salts of phosphoric acid. Further, it is possible to use the salts made by neutralizing a phosphoric acid solution with caustic alkali or aqueous ammonia. It is desirable that the concentration of these alkali phosphates may be in the range of 0.1 g/liter to 50 g/liter as phosphate ion. Further, when the quantity is in the range of 1 g/liter to 20 g/liter, a phosphate conversion coating which is quite excellent in anticorrosiveness can be formed.

Employed as the source of stannous ions are stannous sulfate, stannous fluoride, stannous chloride and stannous borofluoride. The preferable concentration of the stannous ion is in the range of 0.01 g/liter to 0.5 g/liter. When the concentration is less than 0.01 g/liter, the anticorrosiveness becomes worse, and on the other hand, when the concentration is more than 0.5 g/liter, the treating solution becomes unstable and the additional effect in the anticorrosiveness cannot be observed even when the stannous ion is increased above such the quantity.

As the sources of fluorine ion, are exemplified hydrofluoric acid and alkali fluorine compounds such as sodium fluoride, sodium hydrogen fluoride, potassium fluoride, potassium hydrogen fluoride, ammonium fluoride and ammonium hydrogen fluoride. Besides the above hydrofluoric acid and alkali fluorine compounds, hydrosilicofluoric acid, hydroborofluoric acid, their alkali metal salts, hexafluoroaluminium and the like which release free fluorine ions by dissociation in the conversion coating solution may also be used solely or in combination of two or more. The concentration of the fluorine ion is in the range of 2 to 12 by weight ratio against the above-mentioned stannous ion. When the weight ratio is less than 2, insoluble stannous phosphate ion precipitates in the conversion coating solution which undesirably results in the formation of sludge. If the weight ratio is more than 12, the dissolving of substrate metal by corrosion in the conversion treatment becomes large so that the effect of the formation of stannous phosphate coating film is reduced.

In order to obtain the dense and anticorrosive coating films, the pH value of the conversion coating solution may be within the range of 5.5 to 6.5. When the pH becomes higher than 6.5, it is not desirable that an insoluble tin salt of phosphoric acid is produced in the conversion coating solution. If the pH value becomes lower than 5.5, the anticorrosiveness becomes low which is not desirable either. The pH adjustment for the conversion coating solution can be carried out by using a caustic alkali such as caustic soda and phosphoric acid.

It has been found out that the anticorrosiveness can be much improved by adding 0.2 g/liter to 5 g/liter of one or more of pyrazole compounds, hydroxylamine compounds and hydrazine compounds to the conversion coating solution of the above-described composition. The pyrazole compounds are exemplified by 3-methyl-5-hydroxypyrazole, 3,5-dimethyl pyrazole, and 3-methyl-4-amino-5-hydroxypyrazole. The above hydroxylamine compounds are exemplified by hydroxylamine phosphate, hydroxylamine sulfate and hydroxylamine hydrochloride. The hydrazine compounds are exemplified by hydrazine phosphate, hydrazine sulfate and hydrazine hydrochloride. If the addition quantity of these compounds is less than 0.2 g/liter, the effect of improving anticorrosiveness by accelerating the conversion can not be expected, while if the addition quantity of these compounds is more than 5 g/liter, the effect of addition thereof does not increase any more, and therefore, it will be uneconomical. As described above, one or more of film formation promoters such as hydroxylamine compounds, hydrazine compounds and pyrazole compounds having larger reducing property as compared with nitrite ion are added to the conversion coating solution of the acid salts of alkali phosphates of pH 5.5 to 6.5 which contains stannous ion, and thus it has become possible to form continuously the insoluble phosphate coating films and to improve the anticorrosiveness cooperatively.

In the following, the method for conversion coating on the metallic surfaces, especially the products after the drawing of tin-plated steel sheet, with the use of the above-described conversion coating solution of the present invention, will be described in detail.

The metallic products to be treated are firstly cleaned by a weak alkaline degreasing agent. Then they are sprayed with the conversion coating solution or they are dipped into the conversion coating solution. After that, the metallic products are rinsed with water and further dried by hot blast at a temperature of 50° C. to 220° C. The temperature of the conversion coating solution may be the normal temperature, however, if the treatment is carried out by heating the coating solution at a temperature of 45° C. to 70° C. so as to promote the conversion reaction, coating films of excellent anticorrosiveness can be obtained. The preferable time of contact between the metallic products to be treated and the conversion coating solution may be in the range of 10 to 60 seconds. The thus obtained coating films are ready for the next overcoating step or printing step.

As described above, the conversion coating solution of the present invention contains phosphate ion, stannous ion and fluoride ion and the pH valve thereof is in the range of 5.5 to 6.5. The conversion coating solution is quite advantageous in view of the prevention of public hazard because it does not contain noxious metal such as chromium and it is free from the formation of sludge. Further, each component exists in the form of an ion and especially, the fluorine ion and exists in the form of complex ion with the stannous ion, therefore, the conversion coating solution is quite stable and the corrosive action to the substrate surface is made mild. In addition, the work of conversion coating treatment can be carried out continuously under stable conditions.

Furthermore, since the pH value of the conversion coating solution is limited within the certain range and the fluorine and stannous ions are stable in the form of complex ions, the corrosive dissolution of the metallic surface to be treated caused by the conversion reaction is quite little. Therefore, even when thinly tin-plated steel sheets are treated, the plated layer on the metallic surface is not dissolved to a large degree and the phosphate coating consisting of the dense and insoluble tin phosphate can be efficiently formed, thereby providing excellent effect of the conversion coating. Still further, since the obtained phosphate coating film contains tin in itself, the anticorrosiveness of the coating film is quite excellent and thus, the treated material does not gather rust even when it is exposed to the atmosphere of workshop for a long time after the succeeding water rinsing and drying steps. Further, an conversion coating as the undercoating film gives good anticorrosiveness, adhesiveness and surface gloss to an overcoating or printed layer such as thin organic coating film of lacquer.

In order that those skilled in the art may better understand the present invention and the manner in which it may be practised, the following specific examples are given.

EXAMPLE 1

D1S cans having exposed steel surfaces were cleaned by using a 1% hot water solution of a weak alkaline degreasing agent (trademark: Fine Cleaner 4361 made by Nihon Parkerizing Co., Ltd.). After that, the conversion coating treatment was carried out by spraying the following Conversion Coating Solution I to the cans for 30 seconds. After this spraying, the cans were washed with city water and further sprayed with deionized water of above 500,000 Ωcm in specific resistance for, 10 seconds. Then, the cans were dried for 3 minutes in a hot blast furnace at 200° C. These treated cans were immersed into the city water at 60° C. for 30 minutes, thereby performing the test of anticorrosiveness. As shown in the following Table 1, the results were better than those of the following Comparative Example 1.

| Conversion Coating Solution I: | | |
|---|---|---|
| $NaH_2PO_4$ | 15 | g/liter |
| $SnSO_4$ | 0.2 | g/liter |
| $NH_4F$ | 1 | g/liter |
| pH = 5.6, adjusted by NaOH aqueous solution. | | |
| Temperature of Coating Solution: | 60° C. | |

EXAMPLE 2

With using the following Conversion Coating Solution II, the conversion coating treatment was carried out in like manner as Example 1 and the anticorrosiveness tests were carried out likewise.

| Conversion Coating Solution II: | | |
|---|---|---|
| 75% $H_3PO_4$ | 15 | g/liter |
| NaF | 0.8 | g/liter |
| $SnSO_4$ | 0.2 | g/liter |
| $(NH_2OH)_2H_2SO_4$ | 1.8 | g/liter |
| pH = 5.6, adjusted by NaOH aqueous solution. | | |
| Temperature of Coating Solution: | 55° C. | |

As shown in the following Table 1, the anticorrosiveness of these cans treated in this Example was excellent.

EXAMPLE 3

With using the following Conversion Coating Solution III, the conversion coating treatment was carried out in like manner as the foregoing Example 1 and the tests of anticorrosiveness were carried out likewise.

| Conversion Coating Solution III: | | |
|---|---|---|
| $Na_2HPO_4$ | 20 | g/liter |
| NaF | 1.6 | g/liter |
| 3-methyl-5-hydroxypyrazole | 0.5 | g/liter |
| $(NH_2OH)_2H_2SO_4$ | 0.5 | g/liter |
| $SnSO_4$ | 0.4 | g/liter |
| pH = 6.0, adjusted by 75% $H_3PO_4$ aqueous solution. | | |
| Temperature of Coating Solution: | 65° C. | |

As shown in the following Table 1, the anticorrosiveness of these cans treated in this Example was excellent.

COMPARATIVE EXAMPLES

The following Comparative Conversion Coating Solutions were prepared and the conversion coating treatment was carried out in like manner as the foregoing Example 1. Then, the tests for the anticorrosiveness were performed likewise. The results of which are shown in the following Table 1.

COMPARATIVE EXAMPLE 1

| Comparative Conversion Coating Solution I: | | |
|---|---|---|
| $NaH_2PO_4$ | 15 | g/liter |
| $NH_4F$ | 1 | g/liter |
| pH = 5.6, adjusted by NaOH aqueous solution. | | |
| Temperature of Coating Solution: | 60° C. | |

-continued

COMPARATIVE EXAMPLE 2

| Comparative Conversion Coating Solution II: | | |
|---|---|---|
| 75% $H_3PO_4$ | 15 | g/liter |
| NaF | 0.8 | g/liter |
| $(NH_2OH)_2H_2SO_4$ | 1.8 | g/liter |
| pH = 5.6, adjusted by NaOH aqueous solution | | |
| Temperature of Coating Solution: | 55° C. | |

COMPARATIVE EXAMPLE 3

| Comparative Conversion Coating Solution III: | | |
|---|---|---|
| 75% $H_3PO_4$ | 15 | g/liter |
| NaF | 2.0 | g/liter |
| $SnSO_4$ | 0.06 | g/liter |
| $(NH_2OH)_2H_2SO_4$ | 1.8 | g/liter |
| pH = 5.0, adjusted by NaOH aqueous solution | | |
| Temperature of Coating Solution: | 55° C. | |

Table 1

| | Results of Anticorrosiveness Tests | | | | | |
|---|---|---|---|---|---|---|
| | Example | | | Comparative Example | | |
| | 1 | 2 | 3 | 1 | 2 | 3 |
| Red rust formation % | About 30% | Not more than 5% | Not more than 5% | 100% | More than 80% | More than 80% |

EXAMPLE 4

Cold-rolled steel sheets were cleaned by a 2% hot aqueous solution of an alkaline degreasing agent (trademark: Parkocleaner 364 made by Nihon Parkerizing Co., Ltd.) and rinsed with water. The above steel sheets were then subjected to conversion treatment by spraying the following Conversion Coating Solution IV for 1 minute and rinsed with 50° C. hot water and further dried by hot blast at 120° C. The thus treated steel sheets were subjected to electrolytic treatment at 250 V for 3 minutes by using an epoxy electro-deposition coating material (trademark: Elecron made by Kansai Paint Co., Ltd.) and after that, they were baked at 180° C. for 20 minutes. The above obtained conversion-treated steel sheets were then subjected to the salt spray test in accordance with JIS (Japanese Industrial Standard) Z 2371 and, after 240 hours, the widths of blisters of coating from scratched portions were measured. The results were less than 2 mm which were superior to the results of the following Comparative Example 4 in view of the anticorrosiveness.

| Conversion Coating Solution IV: | | |
|---|---|---|
| 75% $H_3PO_4$ | 40 | g/liter |
| NaF | 0.4 | g/liter |
| $SnSO_4$ | 0.1 | g/liter |
| $NaBF_4$ | 0.5 | g/liter |
| $(NH_2OH)_2H_2SO_4$ | 2.5 | g/liter |
| pH = 5.6, adjusted by NaOH aqueous solution. | | |
| Temperature of Coating Solution: | 60° C. | |

COMPARATIVE EXAMPLE 4

A known typical alkali phosphate conversion coating solution of the following Comparative Conversion Coating Solution IV was prepared and the conversion coating treatment and overcoating were carried out in like manner as Example 4.

The salt spray test was also carried out for 240 hours and it was understood that the widths of blistered coatings from scratched portions were more than 10 mm which was inferior to the result of Example 4 in view of the anticorrosiveness.

| Comparative Conversion Coating Solution IV: | |
|---|---|
| 75% $H_3PO_4$ | 10 g/liter |
| NaF | 0.4 g/liter |
| $NaClO_3$ | 3 g/liter |
| pH = 5.6, adjusted by NaOH aqueous solution. | |
| Temperature of Coating Solution: | 60° C. |

From the above-disclosed Examples and Comparative Examples, it will be understood that the conversion coating solution according to the present invention is superior to those in the conventional art.

Although the present invention has been described in connection with preferred Examples thereof, many variations and modifications will now become apparent to those skilled in the art of this technical field. It is preferred, therefore, that the present invention be limited not by the specific disclosure herein but only by the appended claims.

What is claimed is:

1. A conversion coating solution for treating metallic surfaces which has a pH value in the range of 5.5 to 6.5 and contains therein 0.1 g/liter to 50 g/liter as phosphate ion of acid salts of alkali phosphates, 0.01 g/liter to 0.5 g/liter of stannous ion and 2 to 12-fold by weight as much fluorine ion as said stannous ion.

2. The conversion coating solution as claimed in claim 1, containing 0.2 g/liter to 5 g/liter of at least one or more members selected from the group consisting of pyrazole, hydroxylamine and hydrazine compounds.

3. The conversion coating solution as claimed in claim 1 or 2, wherein said acid salts of alkali phosphates are at least one member of acid sodium phosphate, acid potassium phosphate, acid ammonium phosphate or the neutralization product of phosphate with caustic alkali or ammonia.

4. The conversion coating solution as claimed in claim 1 or 2, wherein said stannous ion is formed by dissolving at least one member of stannous sulfate, stannous fluoride, stannous chloride and stannous borofluoride.

5. The conversion coating solution as claimed in claim 1 or 2, wherein said fluorine ion is formed by dissolving at least one member of hydrofluoric acid, sodium fluoride, sodium hydrogen fluoride, potassium fluoride, potassium hydrogen fluoride, ammonium fluoride, ammonium hydrogen fluoride, hydrosilicofluoric acid, hydroborofluoric acid, their alkali metal salts, and hexafluoroaluminium.

6. The conversion coating solution as claimed in claim 2, wherein said pyrazole compound is at least one member of 3-methyl-5-hydroxypyrazole, 3,5-dimethylpyrazole and 3-methyl-4-amino-5-hydroxypyrazole, said hydroxylamine compound is at least one member of hydroxylamine phosphate, hydroxylamine sulfate and hydroxylamine hydrochloride, and said hydrazine compound is at least one member of hydrazine hydrochloride, hydrazine phosphate and hydrazine sulfate.

* * * * *